US007054590B2

(12) United States Patent
Osawa

(10) Patent No.: US 7,054,590 B2
(45) Date of Patent: May 30, 2006

(54) CLEANING DEVICE INCORPORATED IN IMAGE FORMING APPARATUS

(75) Inventor: Tatsuro Osawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/702,218

(22) Filed: Nov. 6, 2003

(65) Prior Publication Data

US 2004/0141780 A1 Jul. 22, 2004

(30) Foreign Application Priority Data

Nov. 6, 2002 (JP) ..... P2002-322192

(51) Int. Cl.
*G03G 21/00* (2006.01)

(52) U.S. Cl. ..... 399/350; 399/351; 399/355

(58) Field of Classification Search ..... 399/343, 399/345, 350, 351, 355, 358, 359, 360
See application file for complete search history.

(56) References Cited

U.S. PATENT DOCUMENTS 5,031,000 A * 7/1991 Pozniakas et al. ..... 399/349
5,066,983 A * 11/1991 Tonomoto ..... 399/349

FOREIGN PATENT DOCUMENTS

JP 08-211797 A 8/1996
JP 2001-051522 A 2/2001

* cited by examiner

*Primary Examiner*—Hoang Ngo
(74) *Attorney, Agent, or Firm*—Sughrue Mion, PLLC

(57) ABSTRACT

A cleaning blade is arranged such that a tip end thereof is brought into contact with a toner image carrying member in an upwardly directed state, to scrape off residual toner from the toner image carrying member. A casing body defines a waste toner chamber accommodating the scraped toner therein. The casing body is formed with an air passage communicated to an exterior of the casing body, so that an air stream is created within the waste toner chamber.

10 Claims, 5 Drawing Sheets

CLEANING DEVICE INCORPORATED IN IMAGE FORMING APPARATUS

BACKGROUND OF THE INVENTION

The present invention relates to a cleaning device incorporated in an image forming apparatus.

In a cleaning device for cleaning off a residual toner on a photosensitive member by upwardly directing a toner control face at a tip end of a cleaning blade to bring it into contact with the photosensitive member, Japanese Patent Publication No. 8-211797A discloses that the toner control face at the tip end of the cleaning blade is made inclined so that the toner may not be heaped on the tip end portion of the cleaning blade, thereby to prevent the toner heaped on the tip end of the cleaning blade from being scattered at the time of attaching and detaching the photosensitive member.

Japanese Patent Publication No. 2001-51522A discloses that a cleaning blade adapted to be contacted with and separated from an intermediate transferring member of a color image forming apparatus is provided in a cleaning device having a toner recovering chamber (a closed space), and the cleaning blade is brought into contact with the intermediate transferring member in an upwardly directed state thereby to clean off a residual toner.

In a case where the tip end of the cleaning blade has been brought into contact with an image carrier in an upwardly directed state as disclosed in the above publications, the toner is liable to be heaped on the tip end portion of the cleaning blade. Particularly, in a case where the toner recovering chamber is a closed space as disclosed in Japanese Patent Publication No. 2001-51522A, the toner is liable to be heaped on the tip end portion of the cleaning blade.

Even in a monochrome type apparatus in which the cleaning blade is kept in contact with the photosensitive member as in Japanese Patent Publication No. 8-211797A, there is anxiety that the toner which has been heaped on the tip end portion of the cleaning blade may fall down (be scattered) at the time of exchanging the photosensitive members.

In the case of the color image forming apparatus as disclosed in Japanese Patent Publication No. 2001-51522A, the cleaning blade must be separated from the image carrier after the cleaning has been finished, and there is arisen a phenomenon that when the cleaning blade is separated, the toner which has been slightly heaped on the tip end portion of the cleaning blade may fall down (be scattered), although in a very small amount. The motions of contacting and separating the cleaning blade with and from the image carrier are effected at every printing, and repeated in an order of ten thousand times or hundred thousand times during a lifetime of the image forming unit. Therefore, even though only a very small amount of the toner falls down per one contacting and separating motion, a considerably large amount of the toner will fall down In total.

Although it is conceived that a receiving tray may be provided for the solution of this problem, a large receiving tray must be prepared in order to afford a capacity enough to receive the fallen toner. This will incur upsizing of the apparatus, and goes against an intention of downsizing the apparatus. Moreover, a method of preventing the toner from being heaped on the tip end portion of the cleaning blade, by applying a bias voltage to the cleaning blade made of electrically conductive rubber to exert electrical force on an electrical charge of the toner has been also known. This method, however, is not appropriate for reducing the cost, because the cleaning blade of the electrically conductive rubber is expensive, and an electric source for applying the bias voltage must be prepared separately, which will incur an increase of the cost

SUMMARY OF THE INVENTION

It is therefore an object of the invention to provide a cleaning device incorporated in an image forming apparatus, and having a cleaning blade which is adapted to be contacted with an image carrier in an upwardly directed state, wherein toner is prevented from being heaped on a tip end of the cleaning blade, so that the toner may not be scattered to the exterior.

In order to achieve the above object, according to the invention, there is provided a cleaning device incorporated in an image forming apparatus, comprising:

a cleaning blade, arranged such that a tip end thereof is brought into contact with a toner image carrying member in an upwardly directed state, to scrape off residual toner from the toner image carrying member; and a casing body, which defines a waste toner chamber accommodating the scraped toner therein, the casing body formed with an air passage communicated to an exterior of the casing body, so that an air stream is generated within the waste toner chamber.

Preferably, the air passage Is arranged at a portion upper than the tip end of the cleaning blade.

Preferably, the cleaning blade is operable to be separated from the image carrying member.

In the above configurations, an air stream is created within the waste toner chamber, because the case body Is provided with the air passage. Accordingly, the toner will be restrained from being heaped on the tip end portion of the cleaning blade, thus preventing the toner from falling down at the time of contacting and separating the cleaning blade.

Preferably, the cleaning device further comprises a plate member arranged between the cleaning blade and the air passage so as to partly block the air stream.

Preferably, the cleaning device further comprises a plate member arranged in the vicinity of an exterior end of the air passage.

Preferably, the cleaning device further comprises a filter attached on the casing body to cover at least one of an interior end and an exterior end of the air passage.

Preferably, the cleaning device further comprises a porous member is provided in the air passage.

In the above configurations, it is possible to prevent the toner from leaking to the exterior.

Preferably, the cleaning device further comprises an air existing duct connected to an exterior end of the air passage.

In the above configuration, it is possible to forcibly create the air stream in the waste toner chamber, and to prevent the toner form being scattered to the exterior.

The toner image carrying member may be a belt-shaped member or a drum-shaped member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
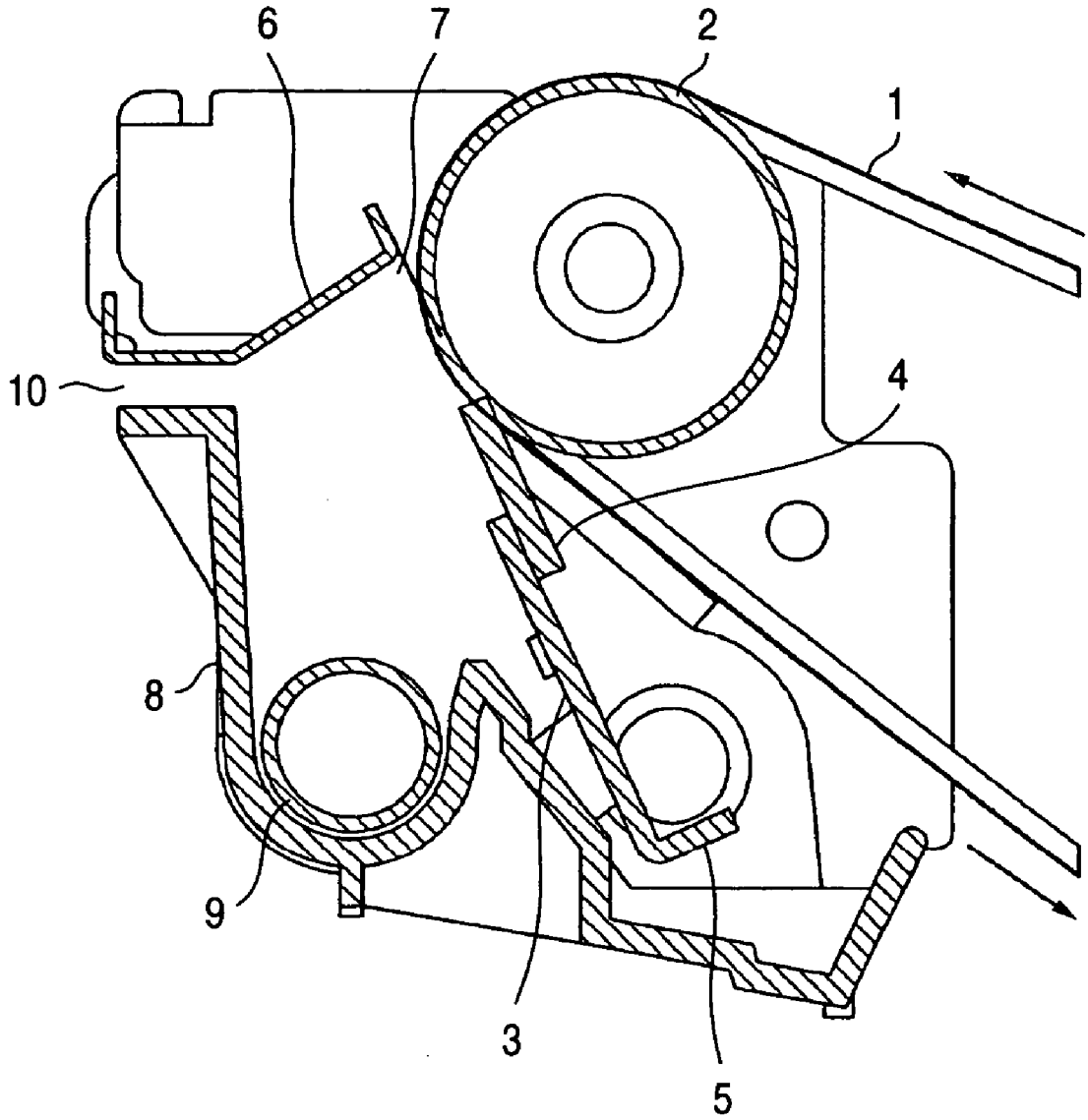
FIG. 1 is a sectional view of an essential part of a cleaning device according to a first embodiment of the invention.

FIG. 1 shows a cleaning device according to a first embodiment of the invention. In this embodiment, an intermediate transfer belt 1 is driven by a driving roller which is not shown, and an image is primarily transferred at a nipped portion with a photosensitive member (not shown) to obtain toner images having various colors overlapped. The toner images having the colors overlapped are collectively transferred to a recording medium (recording paper) at a secondary transferring position.

A tip end of a cleaning blade 4 in an upwardly directed state is in contact with the intermediate transfer belt 1 at a position of a cleaner backup roller 2 so as to scrape off a residual toner after the transfer. The cleaning blade 4 is attached to a blade supporting member 3 made of metal plate or the like. The blade supporting member 3 is pivotable in cooperation with a cam mechanism 5 for enabling the cleaning blade 4 to be contacted and separated with and from the intermediate transfer belt 1. The toner which has been scraped off will be conveyed by a waste toner conveyer 9 which is provided in a bottom of a cleaner case 8 to be recovered.

In an upper place opposed to the cleaning blade 4, a tip end of an upper seal 7 which is attached to a seal supporting member 6 made of metal plate or the like is kept in contact with the intermediate transfer belt 1, in a downwardly directed state.

In the cleaner case 8, the blade supporting member 3, the cleaning blade 4, the seal supporting member 6, the upper seal 7, and wall portions of the case define, in cooperation, a space for recovering the toner. This embodiment is characterized in that an air passage 10 is formed at a back face side of the cleaning blade.

As described above, the toner will be heaped, though a little, on the tip end portion of the cleaning blade which is kept in contact with the intermediate transfer belt 1 in an upwardly directed state, and the toner will be scattered to the exterior of the cleaner case at the contacting and separating motions of the cleaning blade. However, in this embodiment, the air passage 10 will create an air stream within the case, and restrain the toner from being heaped on the tip end portion of the cleaning blade. As the results, the toner can be prevented from falling down to the exterior of the case at the contacting and separating motions of the cleaning blade.

In case of the embodiment of FIG. 1, there is such probability that the toner within the case may leak to the exterior through the air passage 10, and some examples of improvements in which the leakage is prevented will be described below.

Figure 2:
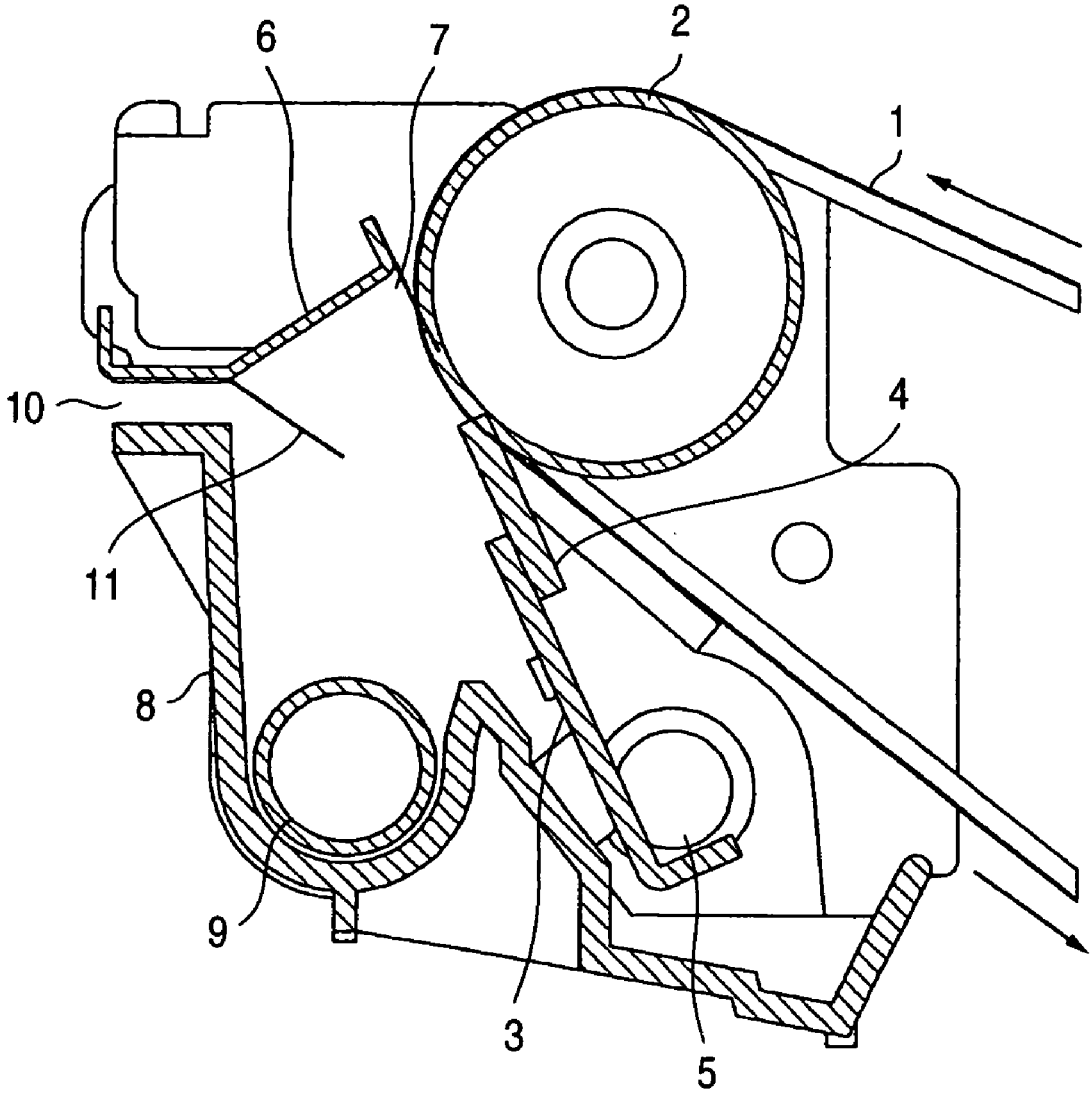
FIG. 2 is a sectional view of an essential part of a cleaning device according to a second embodiment of the invention.

FIG. 2 shows a second embodiment of the invention.

As described above, the air stream is created in the cleaner case 8 by forming the air passage 10, and the toner will be restrained from being heaped on the tip end portion of the cleaning blade. However, there is such probability that the toner which has been scattered by the air stream from the tip end portion of the cleaning blade may flow on the air stream and leak to the exterior of the case through the air passage 10. Therefore, in the present embodiment, a buffer plate 11 is provided at an appropriate position between the air passage 10 and the cleaning blade 4, for example, in such an arrangement that the air passage may be somewhat closed as shown in FIG. 2 and the toner will be prevented from leaking to the exterior.

Figure 3:
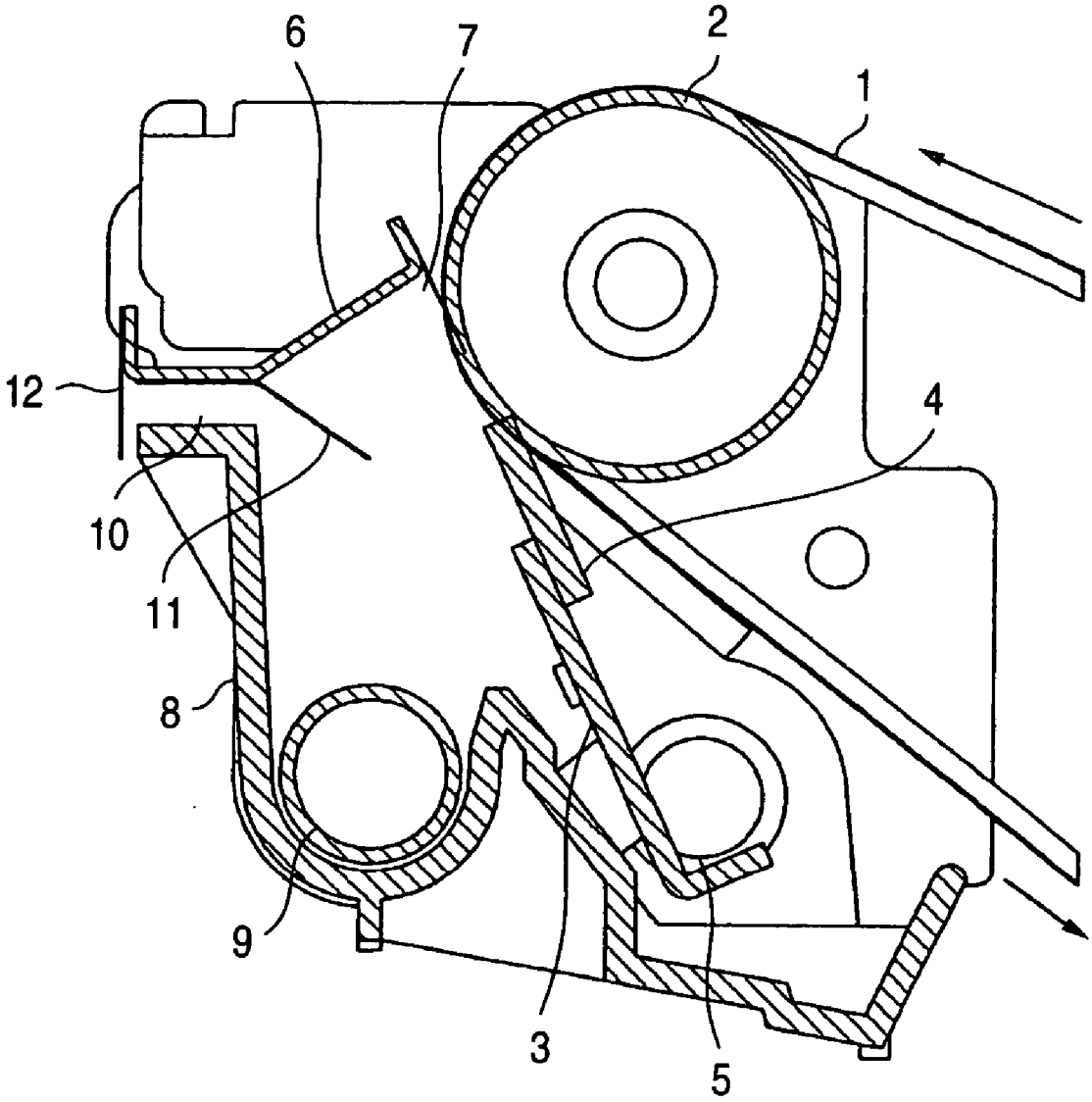
FIG. 3 is a sectional view of an essential part of a cleaning device according to a third embodiment of the invention.

FIG. 3 shows a third embodiment of the invention.

By providing the buffer plate 11 between the air passage 10 and the cleaning blade 4, the leakage of the toner to the exterior by flowing on the air stream can be decreased. Further, in the present embodiment, the toner will be further prevented from leaking to the exterior, by additionally providing a back plate 12 near the outlet of the air passage 10. It is to be noted that the buffer plate may be omitted, and the back plate only may be provided. Also this case, the same effect of preventing the toner from leaking to the exterior can be obtained.

Figure 4:
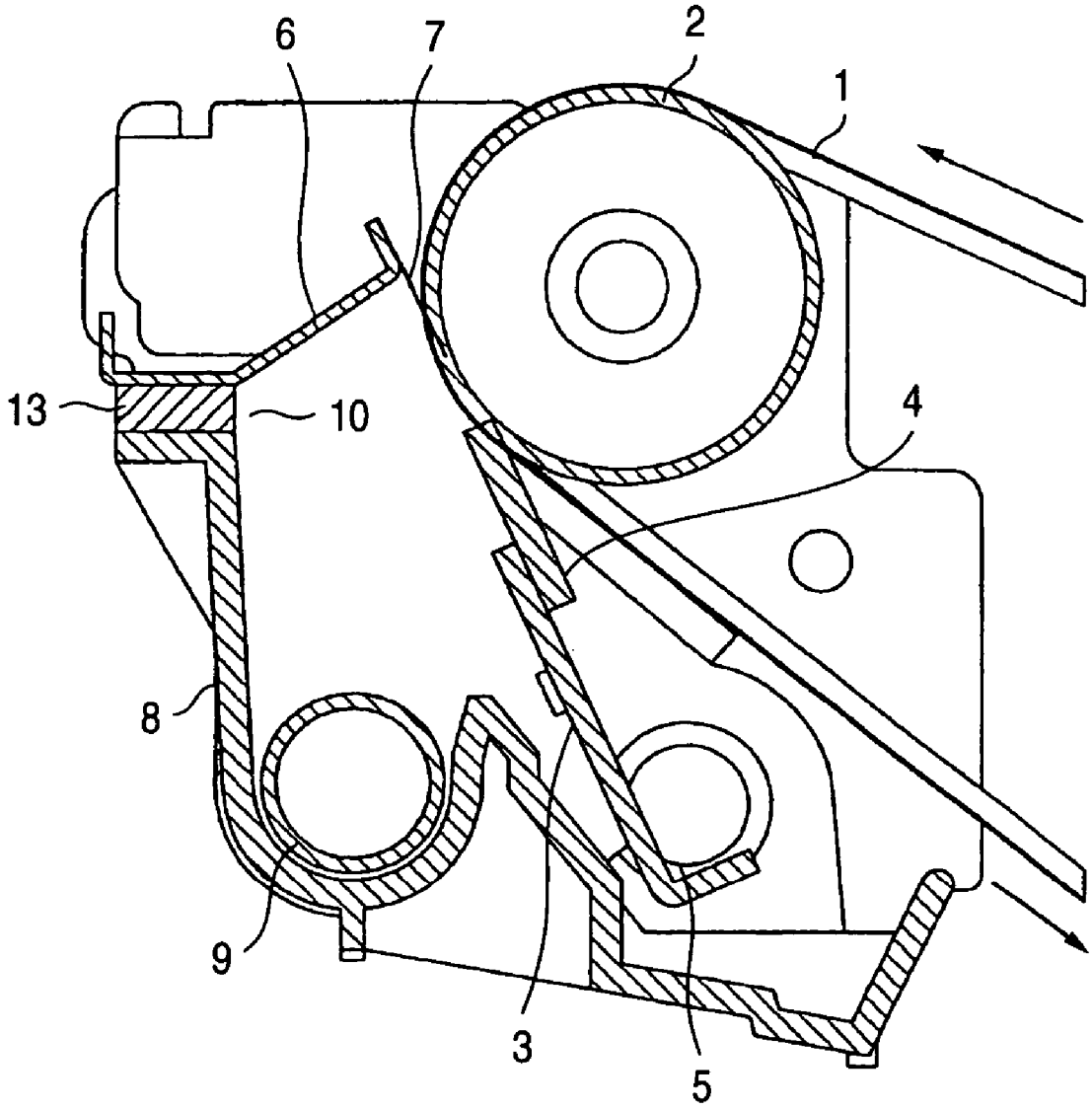
FIG. 4 is a sectional view of an essential part of a cleaning device according to a fourth embodiment of the invention.

FIG. 4 shows a fourth embodiment of the invention.

In this embodiment, an open-cell foamed sponge 13 is inserted into the air passage 10 to close it, so that the toner will be prevented from leaking to the exterior of the case through the air passage. Because the open cell foamed sponge is a sponge having a number of pores, the air stream will be generated inside the case even though the air passage 10 is closed, and the toner will be prevented from being heaped on the tip end portion of the cleaning blade. Since the many pores in the open-cell foamed sponge are small-sized, and besides, passages of the pores are intricate, the toner will not leak to the exterior through the open-cell foamed sponge.

In a case where a filter for blocking the toner is provided at the air passage in place of the open cell foamed sponge, substantially the same effect can be obtained. In a case where the open-ell foamed sponge or the filter, has been employed, the sponge or the filter may be clogged during the use, and generation of the air stream in the cleaner case will be hindered. Therefore, it is desirable to exchange the open-cell foamed sponges or the filters at an adequate interval.

Figure 5:
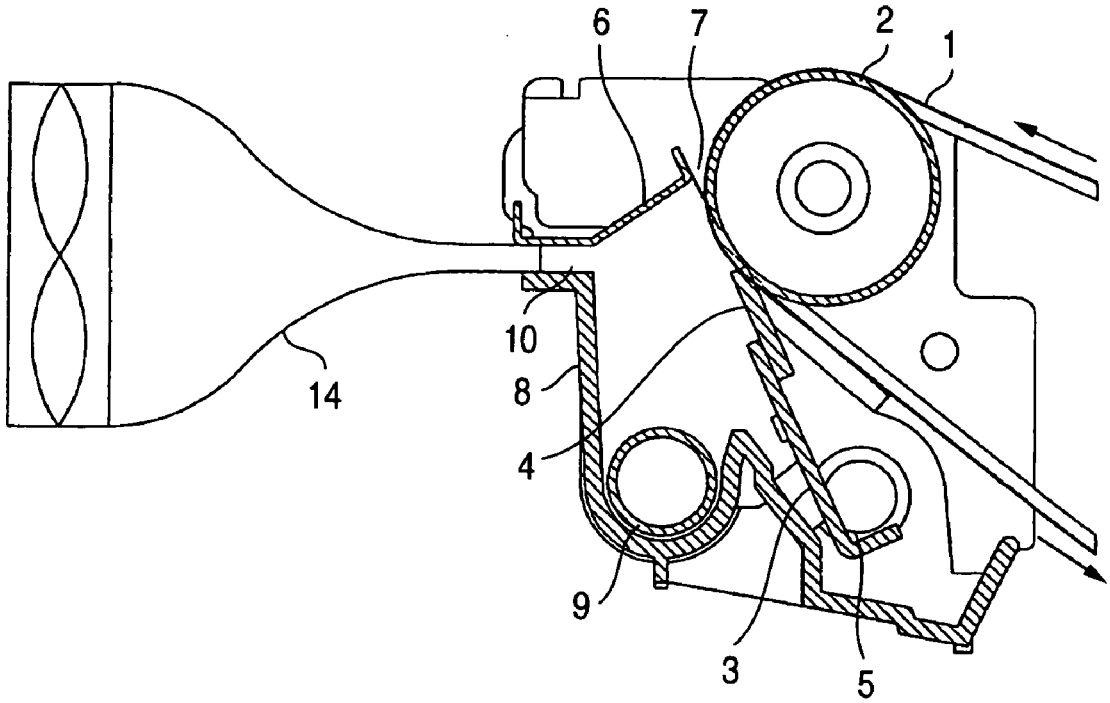
FIG. 5 is a sectional view of an essential part of a cleaning device according to a fifth embodiment of the invention.

FIG. 5 shows a fifth embodiment of the invention.

In the present embodiment, an exhaust duct 14 is connected to an open side of the air passage 10 to exhaust air from the case. This exhaustion will create an air stream in the cleaner case, which restrains the toner from being heaped on the tip end portion of the cleaning blade. As for the toner which may go out through the exhaust duct 14, it is recommended to provide a filter, for example, in the exhaust duct to trap the toner. Alternatively, the exhaust duct may be connected to the air passage 10 together with the above described buffer plate 11, the open ell foamed sponge 13, and the filter.

Although the invention has been described referring to the cleaning of the intermediate transfer belt, the invention is also applicable to a case where the cleaning blade is adapted to be contacted and separated, as in a cleaning device for a photosensitive member.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A cleaning device incorporated in an image forming apparatus, the cleaning device comprising:

a cleaning blade, arranged such that a tip end thereof is brought into contact with a toner image carrying member in an upwardly directed state, to scrape off residual toner from the toner image carrying member;

a casing body, which defines a waste toner chamber accommodating the scraped toner therein, the casing body formed with an air passage communicated to an exterior of the casing body, so that an air stream is created within the waste toner; and a plate member, arranged between the cleaning blade and the air passage so as to partly block the air stream, wherein the plate member is provided separately from the cleaning blade.

2. The cleaning device as set forth in claim 1, wherein the air passage is arranged at a portion upper than the tip end of the cleaning blade.

3. The cleaning device as set forth in claim 1, further comprising a filter attached on the casing body to cover at least one of an interior end and an exterior end of the air passage.

4. The cleaning device as set forth in claim 1, further comprising a porous member is provided in the air passage.

5. The cleaning device as set forth in claim 1, further comprising an air exhausting duct connected to an exterior end of the air passage.

6. The cleaning device as set forth in claim 1, wherein the toner image carrying member is a belt-shaped member.

7. The cleaning device as set forth in claim 1, wherein the toner image carrying member is a drum-shaped member.

8. The cleaning device as set forth in claim 1, wherein the plate member is arranged in the vicinity of an interior end of the air passage.

9. The cleaning device as set forth in claim 1, further comprising:

a conveyor, disposed in the waste toner chamber and operable to convey the scraped toner to be recovered, wherein the plate member is disposed above the conveyor.

10. A cleaning device, comprising:

a cleaning blade arranged such that a tip end thereof is brought into contact with a toner image carrying member in an upwardly directed state, to scrape off residual toner from the toner image carrying member;

a casing body, which defines a waste toner chamber accommodating the scraped toner therein, the casing body formed with an air passage communicated to an exterior of the casing body, so that an air stream is created within the waste toner chamber; and a plate member arranged in the vicinity of an exterior end of the air passage.

* * * * *